US006371287B1

(12) United States Patent
Jones et al.

(10) Patent No.: US 6,371,287 B1
(45) Date of Patent: Apr. 16, 2002

(54) FULL PROTECTION BASKET CARRIERS AND METHOD OF FORMING

(75) Inventors: Marty Jones, Graham, NC (US); Robert L. Sutherland, Kennesaw; Jean-Manuel Gomez, Marietta, both of GA (US)

(73) Assignee: Riverwood International Corporation, Atlanta, GA (US)

( * ) Notice: Subject to any disclaimer, the term of this patent is extended or adjusted under 35 U.S.C. 154(b) by 0 days.

(21) Appl. No.: 09/680,080

(22) Filed: Oct. 3, 2000

(51) Int. Cl.[7] ..... B65D 75/00
(52) U.S. Cl. ..... 206/180; 206/178; 206/173
(58) Field of Search ..... 206/162, 167, 206/170, 173–178, 180, 181, 188, 193, 198, 200; 229/117.12; 493/228, 229, 237, 240, 88

(56) References Cited

U.S. PATENT DOCUMENTS 4,605,464 A * 8/1986 Slevin ..... 156/253
4,770,294 A * 9/1988 Graser ..... 206/180
5,547,074 A * 8/1996 Plaxico et al. ..... 206/193
5,941,377 A * 8/1999 Hart et al. ..... 206/175
5,947,273 A * 9/1999 Dalrymple et al. ..... 206/178
6,131,729 A * 10/2000 Eckermann et al. ..... 206/178
6,230,881 B1 * 5/2001 Collura ..... 206/175

* cited by examiner

*Primary Examiner*—Mickey Yu
*Assistant Examiner*—Jila M. Mohandesi

(57) ABSTRACT

The present invention relates to a basket carrier that provides full protection for the bottles being carried, and which can be glued on a straight-line gluer. The provision of nicks (i.e., temporary bridges) between the handle panels and the side walls serves to keep the handle panels in proper alignment during the folding and gluing operation on the gluer. These nicks are easily broken when the carrier is opened to receive bottles in the bottling plant. The present invention also utilizes nicks between the partition panel and the handle ply to hold them in contact but yet prevent bunching of paperboard during the folding and gluing process.

2 Claims, 5 Drawing Sheets

FULL PROTECTION BASKET CARRIERS AND METHOD OF FORMING

BACKGROUND OF THE INVENTION

1. Field of the Invention

The present invention relates to basket carriers with full protection for bottles and a four-ply handle. These carriers have been designed so that this can be folded and glued on a straight-line gluer. A small nick is provided between each side wall and the adjoining ply of the handle panel to maintain the handle panel in proper position in respect to the carrier during the folding and gluing operation. Small nicks are provided in the cut line between an adjoining handle ply and partition panel to make folding on a straight-line gluer feasible The present invention also relates to a method of folding and gluing of full protection basket carriers of this invention.

2. Background of the Invention

Basket carriers with full protection for the bottles have been around for many years. These have normally had to be glued on right-angle gluers in order to ensure that all of the panels and flaps that were being glued were in proper position when glued. The timing involved in a right-angle gluer facilitated the folding and gluing of these carriers. It would be desirable if full protection basket carriers could be folded and glued on straight-line gluers as it reduces the cost and the complexity of the folding and gluing process and eliminates the need for timing.

SUMMARY OF THE INVENTION

It is an object of this invention to provide a full protection basket carrier with a four-ply handle that can be folded and glued on a straight-line gluer and to provide a method for such folding and gluing.

The objects of this invention have been achieved in a full protection basket carrier. The blank has a nick between a ply of the handle panel and adjoining side wall which stays intact during the folding and gluing operation and is only broken when the basket carrier is opened to receive bottles. The blank has nicks in the cut line between an adjoining handle ply and partition panel to make folding on a straight-line gluer feasible. A method has also been developed for folding and gluing these carriers on a straight-line gluer.

These and other objects, features, and advantages of the present invention will become more apparent upon reading the following specification in conjunction with the accompanying drawing figures.

DETAILED DESCRIPTION OF THE PREFERRED EMBODIMENTS

The present invention are basket carriers that provide full protection for the bottles being carried. These carriers can be formed from a single piece of foldable material, such as the blank cut out of paperboard. The layout of the blank is basically rectangular, which results in economizing the amount of paperboard used. These carriers can be used for carrying from four to twelve bottles. They are especially designed to carry six bottles. These carriers are characterized by having a nick between each side wall and an adjoining ply of the handle panel for keeping the handle panel in proper position during the folding and gluing operation. This nick is designed to remain intact until the carrier is opened for receiving bottles. In addition, these carriers have four-ply handles in which a handle ply is attached at its top end to a partition panel by small nicks in the cut line about which the plies are folded to construct the multi-ply handle.

A method for folding and gluing these cartons has been developed for carrying out the operation on a straight-line gluer.

1. First Embodiment of the Invention

Figure 1:
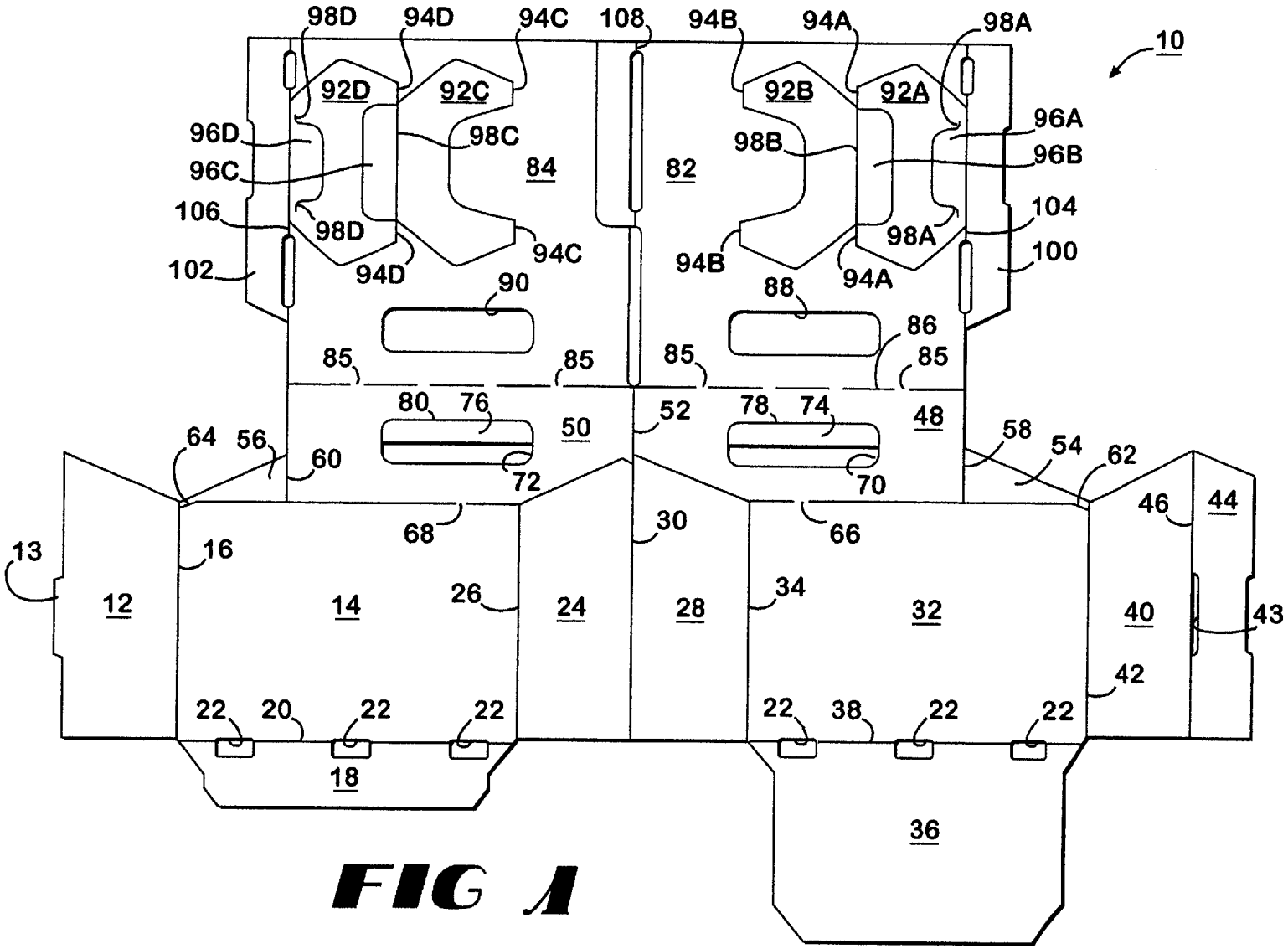
FIG. 1 is a plan view of the blank for forming the first embodiment of the full protection basket carrier of this invention.

FIG. 1 is a plan view of one embodiment of this invention. The blank is represented by the numeral 10. End flap 12 is foldably connected to side wall 14 by fold line 16. Side wall 14 is foldably connected to glue flap 18 by fold line 20. There are heel apertures 22 which are designed to receive a portion of the heel of the bottle when it is loaded into the carrier.

Side wall 14 is connected to end flap 24 by fold line 26, and in turn is connected to end flap 28 by fold line 30. End flap 28 is foldably connected to side wall 32 by fold line 34. Side wall 32 is connected to bottom panel 36 by fold line 38. Side wall 32 is connected to end flap 40 by fold line 42. End flap 40 is foldably connected to riser panel flap 44 by fold line 46.

Handle panel 48 is interconnected to handle panel 50 by fold line 52. Handle panels 48 and 50 are supported by handle support panels 54 and 56, which are interconnected to the handle panels by fold lines 58 and 60, respectively. Handle support panels 54 and 56 are foldably connected to end flaps 40 and 12 by fold line 62 and 64, respectively. Handle panels 48 and 50 are temporarily attached to side walls 32 and 14 by nicks (i.e., temporary bridges) 66 and 68. These nicks hold the handle panels 48 and 50 in proper position during the folding and gluing operation. Their function will be discussed in more detail infra. Handle panels 48 and 50 have hand apertures 70 and 72, respectively. Hand aperture 70 may have a cushioning flap 74 connected to handle panel 48 by fold line 78. Similarly, hand aperture 72 may have a cushioning flap 76 connected to handle panel 50 by fold line 80.

Partition panels 82 and 84 are respectively attached to handle panels 48 and 50 by nicks 85 in cut line 86. These nicks 85 facilitate the folding of partition panels 82 and 84 about cut line 86 during the folding and gluing of the carrier. The nicks 85 are needed to hold the partition panels 82 and 84 as part of the blank 10. At least two spaced apart nicks are needed and preferably four nicks are used. The cut line 86 is necessary so that the folding can be completed on a straight-line gluer without bunching of the paperboard around cut line 86. Partition panels 82 and 84 have hand apertures 88 and 90, respectively. Partition panels 82 and 84 have cell dividers 92A–D struck from the partition panels. These cell dividers are foldably attached to their respective partition panels by fold lines 94A–D. Glue tabs 96A–D are foldably attached to cell dividers 92A–D by fold lines 98A–D, respectively. Strengthening flaps 100 and 102 are attached to partition panels 82 and 84 by fold lines 104 and 106, respectively. Partition panels 82 and 84 are foldably attached to each other by fold line 108.

A. Folding and Gluing the Carrier

Figure 2:
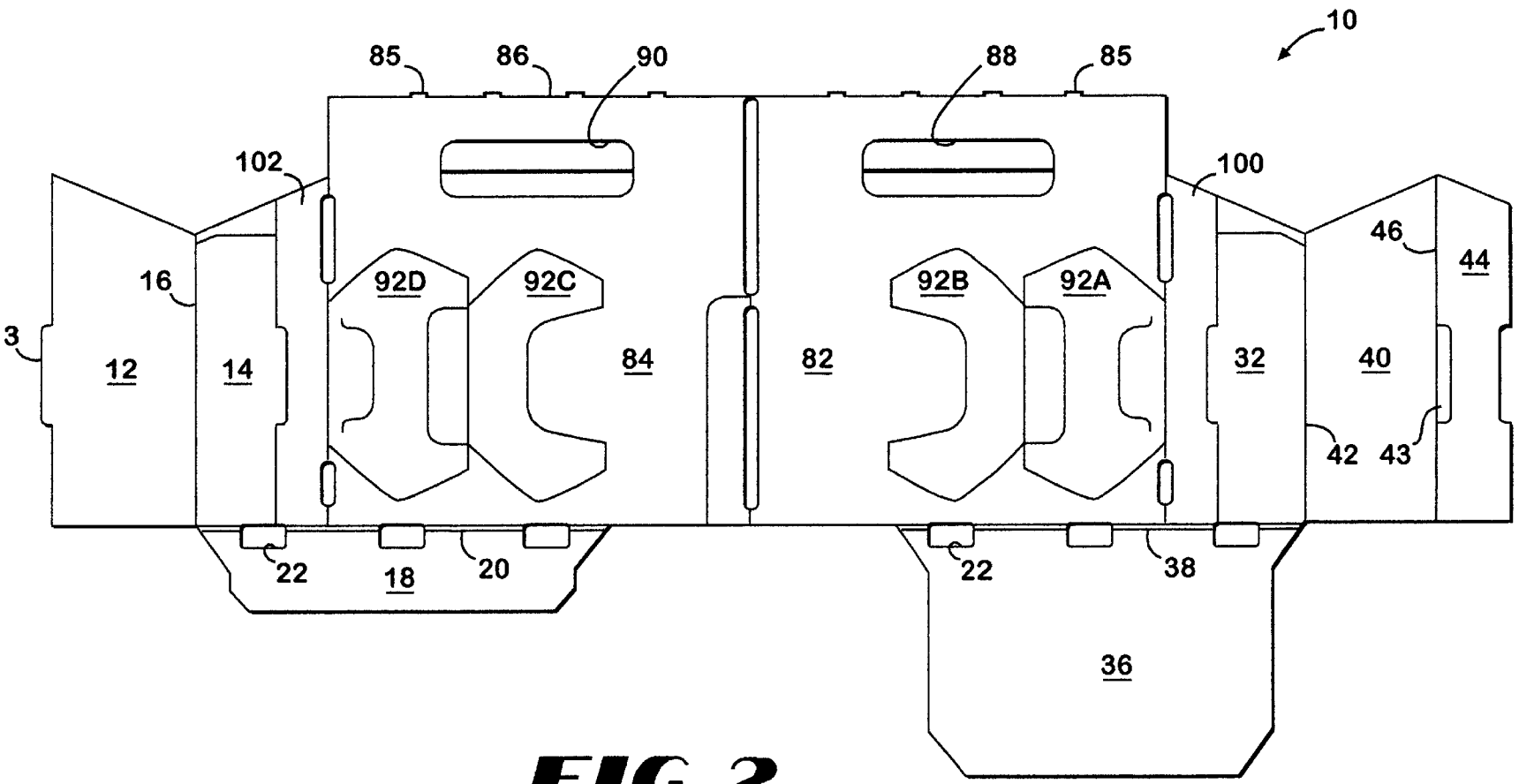
FIG. 2 is a plan view of the blank in which the partition panels have been folded onto the side walls in the first step of folding and gluing the carrier of this invention.
Figure 3:
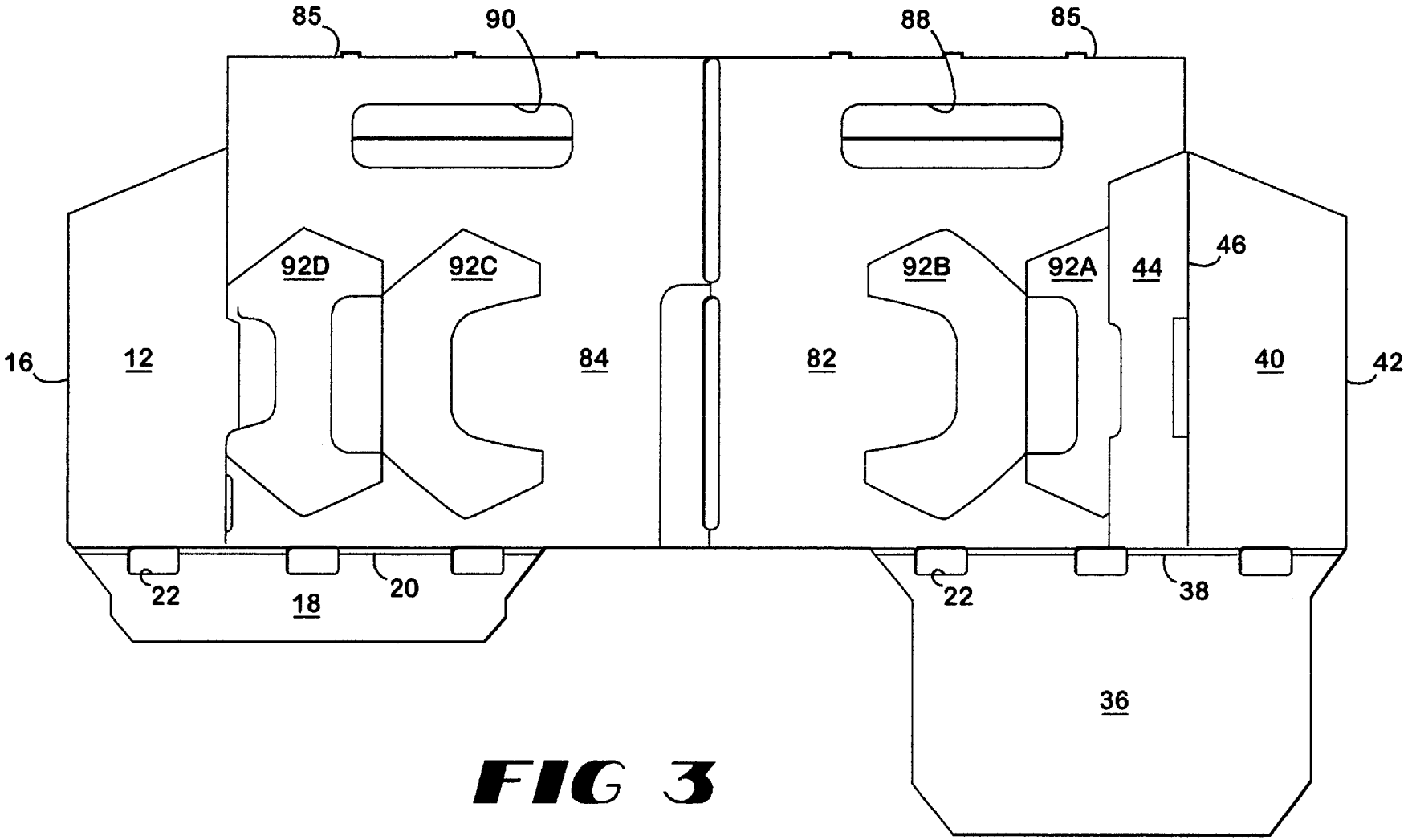
FIG. 3 is a plan view of the blank in which the end flaps have been folded over the partition panels.
Figure 4:
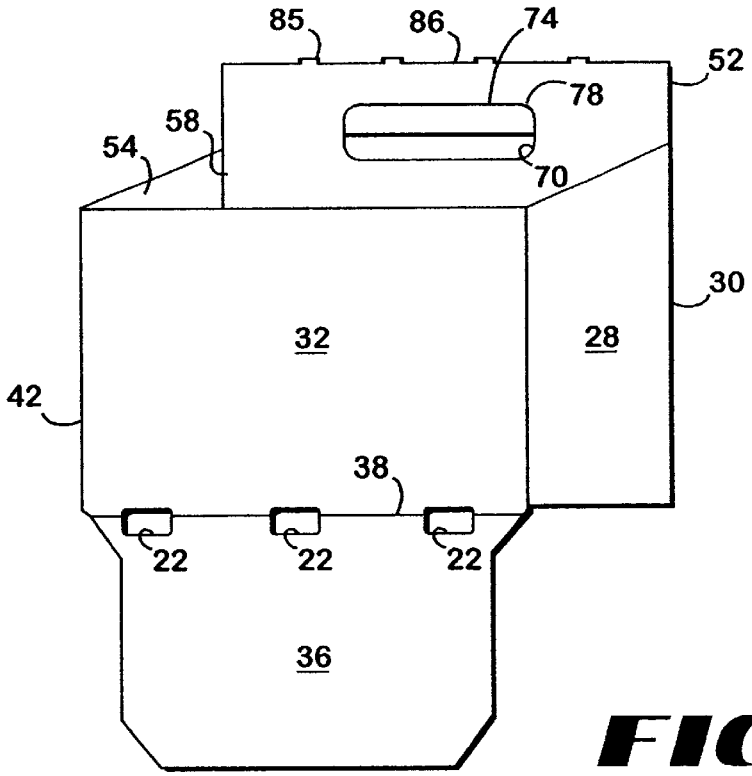
FIG. 4 is a plan view of the blank that has been folded into a folded carrier.
Figure 5:
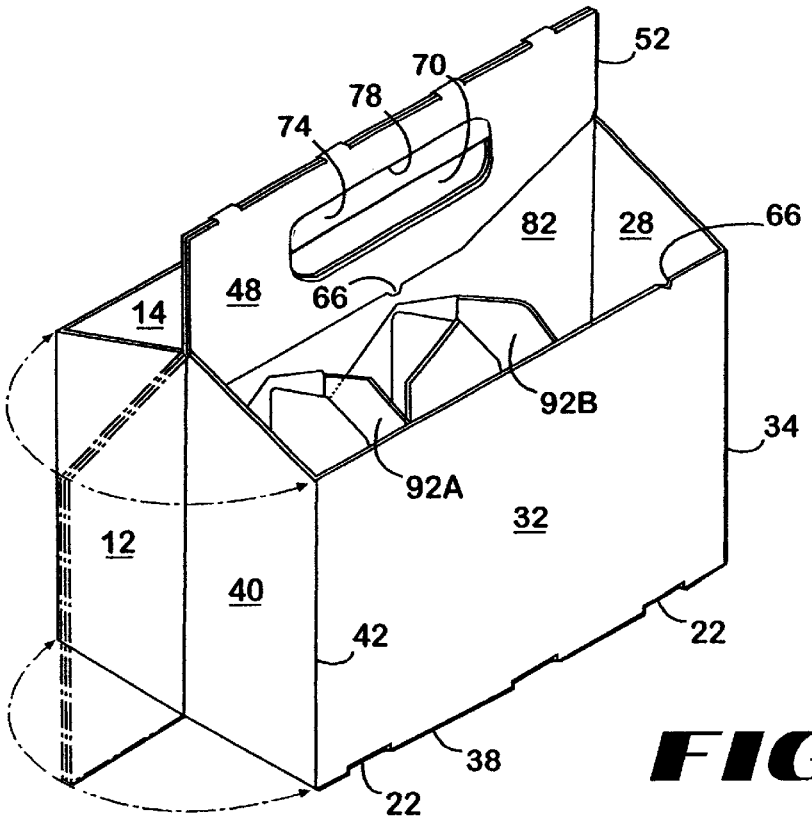
FIG. 5 is a perspective view of the carrier of this invention which has been opened for receiving bottles.

The blank 10 is moved down the conveyor belt of the straight-line gluer transversely, i.e., parallel to fold lines 30 and 108. Partition panels 82 and 84 are flipped over along cut line 86 onto handle panels 48 and 50, and side walls 32 and 14, respectively. This is a simple procedure because of cut line 86 and nicks 85, which allow the partition panels 82 and 84 to be easily flipped and to remain in flat contact with the blank 10. Glue may be applied to handle panels 48 and 50 to hold the handle panels to the partition panels 82 and 84. Completion of this step is shown in FIG. 2. Glue tabs 96A–D are glued to side walls 32 and 14. End flaps 12 and 40 are flipped inwardly, as shown in FIG. 3. The carrier is then flipped along fold lines 30 and 108, and riser panel 44 is attached to end panel 12 with tab 13; extending through aperture 43 and glued to end flap 40. The tab serves to prevent end flaps 12 and 40 from opening outwardly. The bottles serve to keep the end flaps 12 and 40 from opening inwardly. Partition panels 84 and 82 are glued together to form the completed carrier as shown in FIG. 4.

This folding and gluing operation can be completed on a straight-line gluer because all of the folds are either transverse or longitudinal in relation to the conveyor belt of the straight-line gluer. The folding of partition panels 82 and 84 is facilitated because the nicks 85 hold the panels to handle panels 48 and 50 and cut line 86 allows partition panels 82 and 84 to be simply flipped over. No special steps are necessary for the partition panels 82 and 84 to lay flat against handle panels 48 and 50. There is no necessity to have these particular operations timed as they can be completed when they reach the proper station along the conveyor belt.

One of the problems with straight-line gluers is that panels or flaps of cartons tend to get out of line as they proceed down the conveyor belt. It has been found that this problem is eliminated by the provision of nicks 66 and 68 between handle panels 48 and 50, and side walls 32 and 14, respectively. These nicks are sufficient to hold the handle panel in proper position during the folding and gluing operation.

The carrier can be filled with bottles in the bottling plant by opening the carrier which breaks the nicks 66 and 68. The carrier is then lowered over a group of bottles, and glue flap 18 is glued to bottom panel 36 to complete the filling and erection steps. This carrier has a single bottom panel 36 held in place by a glue flap 18.

2. Second Embodiment of the Invention

Figure 6:
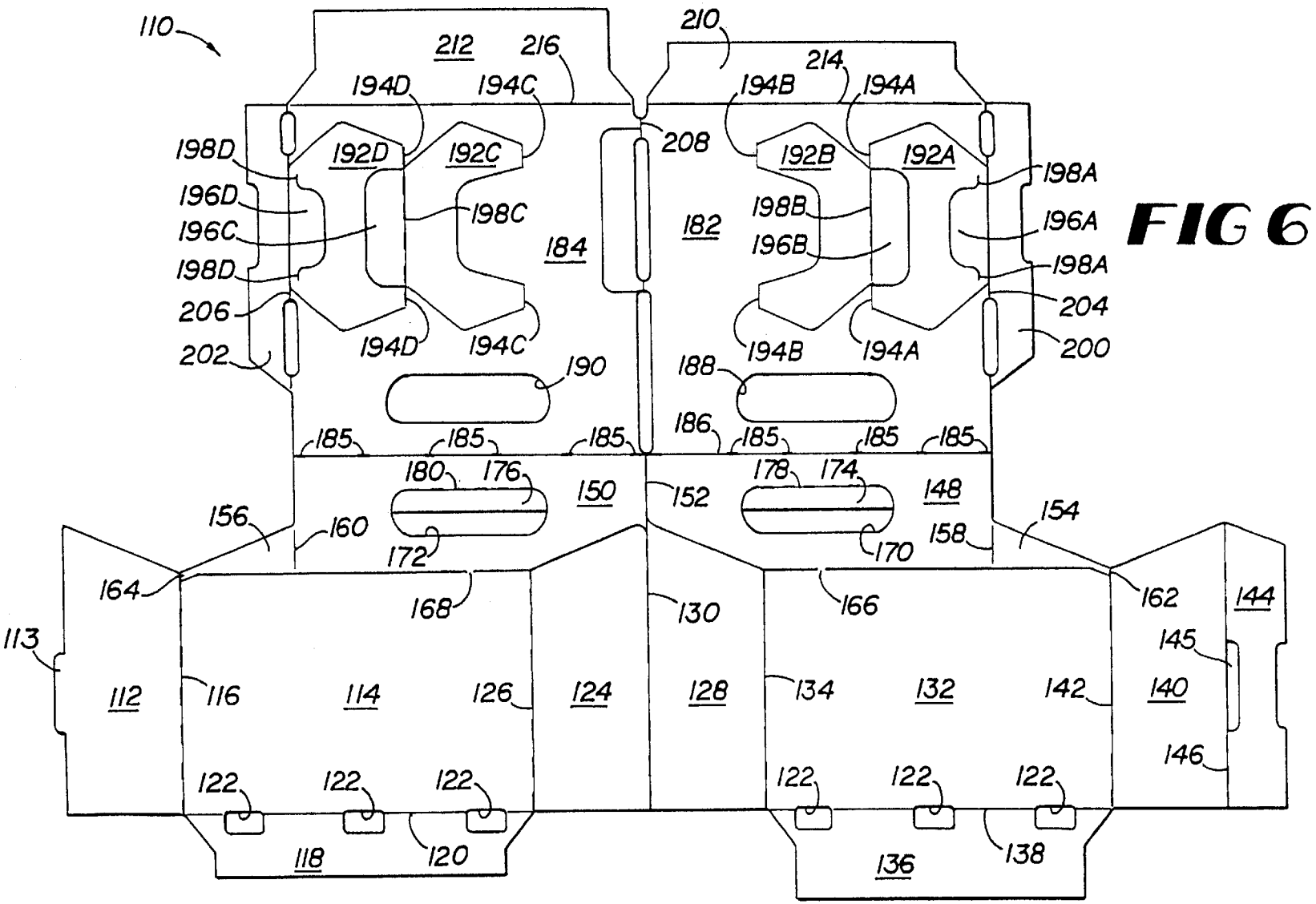
FIG. 6 is a plan view of the blank for forming the second embodiment of the full protection basket carrier of this invention.

FIG. 6 is a plan view of the second embodiment of this invention. This blank is similar to the first embodiment except it has flaps that form the bottom panel rather than a large bottom panel. The blank is represented by the numeral 110. End flap 112 is foldably connected to side wall 114 by fold line 116. Side wall 114 is foldably connected to glue flap 118 by fold line 120. There are heel apertures 122, which are designed to receive a portion of the heel of the bottle when it is loaded into the carrier.

Side wall 114 is connected to end flap 124 by fold line 126, and in turn connected to end flap 128 by fold line 130. End flap 128 is foldably connected to side wall 132 by fold line 134. Side wall 132 is connected to bottom flap 136 by fold line 138. Side wall 132 is foldably connected to end flap 140 by fold line 142. End flap 140 is foldably connected to riser panel 144 by fold line 146.

Handle panel 148 is interconnected to handle panel 150 by fold line 152. Handle panels 148 and 150 are supported by handle support panels 154 and 156, which are interconnected to handle panels by fold lines 158 and 160, respectively. Handle support panels 154 and 156 are foldably connected to end flaps 140 and 112 by fold lines 162 and 164, respectively. Handle panels 148 and 160 are temporarily attached to side walls 114 and 132 by nicks 166 and 168. These nicks hold the handle panels 148 and 150 in proper position during the folding and gluing operation. Handle panels 148 and 150 have hand aperture 170 and 172, respectively. Hand aperture 170 may have a cushioning flap 174 connected to handle panel 148 by fold line 178. Similarly, handle aperture 172 may have a cushioning flap 176 connected to handle panel 150 by fold line 180.

Partition panels 182 and 184 are respectively attached to handle panels 148 and 150 by nicks 185 along cut line 186. As is the case of the first embodiment, these nicks 185 facilitate folding the partition panels 182 and 184 about cut line 186 over onto handle panels 148 and 150, respectively. Partition panels 182 and 184 have hand apertures 188 and 190, respectively. Partition panels 182 and 184 have cell dividers 192A–D struck from the partition panels. These cell dividers are foldably attached to their respective partition panels by fold lines 194A–D. Glue tabs 196A–D are foldably attached to cell dividers 192A–D by fold lines 198A–D, respectively. Strengthening flaps 200 and 202 are attached to partition panels 182 and 184 by fold lines 204 and 206, respectively. Partition panels 182 and 184 are foldably attached to each other by fold line 208. Glue flaps 210 and 212 are attached to partition panels 182 and 184 by fold lines 214 and 216, respectively.

A. Folding and Gluing the Carrier

The blank 110 is moved down the conveyor belt of a straight-line gluer transversely, i.e., parallel to fold lines 130 and 208. Partition panels 182 and 184 are flipped over onto the handle panels 148 and 150 and side walls 132 and 124, respectively. Cut line 186 allows the partition panels to lay flat against handle panels 148 and 150, yet the nicks hold the partition panels 182 and 184 to the blank. Glue may be applied to handle panels 148 and 150 to hold the handle panels to the partition panels 182 and 184. Glue tabs 196A–D are glued to side walls 132 and 114. End flaps 112 and 140 are flipped, and riser panel 144 is interlocked to end flap 112 by tab 113 (which is glued to end flap 140) entering aperture 145 from the outside of aperture 145. Partition panels 182 and 184 are glued together to form the finished completed carton.

In order to prevent the handle panels from getting twisted or improperly aligned as they proceed down the conveyor belt, nicks 166 and 168, between handle panels 148 and 150 and side walls 132 and 114, respectively hold the handle panels in proper position. These nicks are sufficient to hold the handle panels in proper position, but yet are easily broken when the carrier is set up in the bottling plant.

Opening the carrier in the bottling plant breaks the nicks 166 and 168. Glue flaps 210 and 212 are glued to glue flaps 136 and 118, respectively to form the bottom of the carrier.

While the invention has been disclosed in its preferred forms, it will be apparent to those skilled in the art that many modifications, additions, and deletions can be made therein without departing from the spirit and scope of the invention and its equivalents as set forth in the following claims.

What is claimed is:

1. A glued folding basket carrier for carrying a plurality of bottles comprising:

a. a bottom panel with side and end walls with each wall extending from the bottom panel to a top edge of the wall, one end wall being composed of two end flaps, with one end flap being attached to a riser panel which has an aperture and the other end flap has a tab which help hold the end wall in a closed position when said tab is inserted into said aperture and glued to the end flap attached to the riser panel; and b. a multi-ply handle extending above the top edges of the side and end walls with at least one ply attached to the top edge of each side wall in at least two spaced apart locations with at least one nick therebetween temporarily attaching a ply of a handle to the top edge of each adjoining side wall, and c. a pair of partition panels with each panel being attached to a handle ply by at least two nicks.

2. The basket carrier of claim 1, wherein each partition panel is attached to an adjoining handle ply by at least four nicks.

* * * * *